US007086427B2

(12) United States Patent
Bonich

(10) Patent No.: US 7,086,427 B2
(45) Date of Patent: Aug. 8, 2006

(54) VACUUM PUMP FOR BOTTLES

(76) Inventor: Marta Brucart Bonich, Bertrand Russel 31 Casellamau, E-08206 Sabadell (ES)

( * ) Notice: Subject to any disclaimer, the term of this patent is extended or adjusted under 35 U.S.C. 154(b) by 29 days.

(21) Appl. No.: 10/515,153

(22) PCT Filed: May 20, 2003

(86) PCT No.: PCT/ES03/00225

§ 371 (c)(1),
(2), (4) Date: Nov. 19, 2004

(87) PCT Pub. No.: WO03/097464

PCT Pub. Date: Nov. 27, 2003

(65) Prior Publication Data

US 2005/0178094 A1 Aug. 18, 2005

(30) Foreign Application Priority Data

May 20, 2002 (ES) ..... 200201144

(51) Int. Cl.
*B65B 1/04* (2006.01)

(52) U.S. Cl. ..... 141/65; 141/98

(58) Field of Classification Search ..... 141/64, 141/65, 67, 98; 215/228, 260; 417/553, 417/554

See application file for complete search history.

(56) References Cited

U.S. PATENT DOCUMENTS

| | | | | |
|---|---|---|---|---|
| 4,763,803 | A | 8/1988 | Schneider | |
| 4,889,250 | A | 12/1989 | Beyer | |
| 5,031,785 | A | 7/1991 | Lemme | |
| 5,469,979 | A | 11/1995 | Chiou | |
| 5,535,900 | A | 7/1996 | Huang | |
| 5,540,557 | A | 7/1996 | Carson | |
| 5,653,352 | A * | 8/1997 | Kim | 215/228 |

* cited by examiner

*Primary Examiner*—Steven O. Douglas
(74) *Attorney, Agent, or Firm*—Michael J. Striker

(57) ABSTRACT

The invention relates to a hemi-cannula for tracheotomy patients, comprising a main tubular body (1.1) which is made from a suitable flexible material and which comprises peripheral end fixing flanges (1.2 and 1.3). One of said flanges (1.2), which is intended to be disposed inside the trachea next to the inner face of same, takes the form of a wing comprising a cylindrical surface with an oblique axis in relation to an axis perpendicular to the main axis of the main body (1.1). The other flange (1.3) takes the shape of a truncated cone comprising a larger outer base. According to the invention, a conduit forming the main tubular body passes through the centre of both of said flanges. The invention is suitable for producing tracheotomy cannulas.

6 Claims, 2 Drawing Sheets

VACUUM PUMP FOR BOTTLES

OBJECT OF THE INVENTION

The present invention refers to a vacuum pump which has been especially designed as a closing means for bottles, such as wine bottles for example, which allows for maintaining optimum environmental conditions inside the bottle once the primary opening thereof has been carried out and part of its content has been consumed.

BACKGROUND OF THE INVENTION

In the preferred scope of practical application of the invention, that of wine-containing bottles, the latter are marketed with a semi-hermetic closure, specifically through a cork stopper, such that the latter allows the bottle to "breathe", but without the wine coming into direct contact with the air.

Once the bottle is opened and if its entire content is not consumed, the air mass which completes the capacity of the bottle with the wine determines a wine oxidation, with the resulting and rapid deterioration thereof.

In attempting to avoid this drawback, different solutions are known, such as filling the empty space of the bottle with an inert gas or applying a vacuum effect to said bottle minimizing the oxidation process in a very substantial manner, prolonging the useful life of the wine in a more than a sufficient extent so that the total consumption thereof occurs.

In this last aspect, stoppers are known which are provided with a one-way valve, requiring the aid of an absorbent pump, a "bicycle-type pump", which represents an uncomfortable, sizeable and scarcely effective solution.

DESCRIPTION OF THE INVENTION

The vacuum pump for bottles proposed by the invention, belonging to the last group mentioned, i.e. to the group of mechanisms which allow for extracting most of the air contained in the bottle once the closure thereof is carried out, solves in a completely satisfactory manner the drawbacks set forth above.

To that end and more specifically, the pump proposed is structured by means of the functional combination of three basic parts, a support intended to be externally coupled to the neck of the bottle, a stopper which, traversing said support, is coupled inside the neck of the bottle establishing a leak-tight closure with the latter and internally incorporating a one-way valve, and a cap assembled on said support, which can be axially moved with regard thereto and which in turn constitutes a second one-way valve, such that maintaining said support stabilized with regard to the bottle with one of the hands of the user, when the cap is axially moved in the extraction direction, the one-way valve defined between the cap and support closes and the valve arranged in the stopper opens, whereby the air from the bottle passes to the chamber comprised between the stopper and the cap, whereas in the movement of said cap in the opposite direction, the valve of the stopper is what closes and the valve arranged between the cap and the support is what opens, the air flowing out to the exterior, such that an alternative and repetitive operation of the type mentioned causes an absorbent pumping which little by little gives rise to the vacuum inside the bottle. It is worth mentioning that the pumping caused by means of the movement of said cap is of a remarkable capacity, unlike known pumps which use the internal plunger model.

The one-way valve arranged in the internal stopper consists of two cylinders duly fixed in an axial opening of the stopper itself, substantially spaced from one another, leaving a small chamber in which a sealing disk of slightly smaller diameter than that of said cylinders functions, such that the internal cylinder has an axial opening on which the sealing disk acts when the valve closes, whereas the external cylinder, also provided with an axial opening, has peripheral grooves, in the direction of its generatrices, which, due to their own position, cannot be sealed by the intermediate disk.

For its part, the one-way valve connecting the support with the cap consists of an o-ring seal housed in a perimetral channel of the support and on which the side wall of the cap acts, said channel being of substantially greater radius of curvature than the radius of the o-ring seal, such that the latter is movable, dragged by the cap, in either direction, specifically enhancing the closure when it moves in the direction of closure of said valve, and being located in correspondence with grooves or windows of the support which allow for the outflow of the air, i.e. the valve opening, in the movement of the cap in the opposite direction.

DESCRIPTION OF THE DRAWINGS

To complement the description being made and for the purpose of helping to better understand the features of the invention, according to a preferred practical embodiment example thereof, a set of drawings is attached as an integral part of said description, wherein the following has been shown in an illustrative and non-limiting manner.

PREFERRED EMBODIMENT OF THE INVENTION

Figure 2:
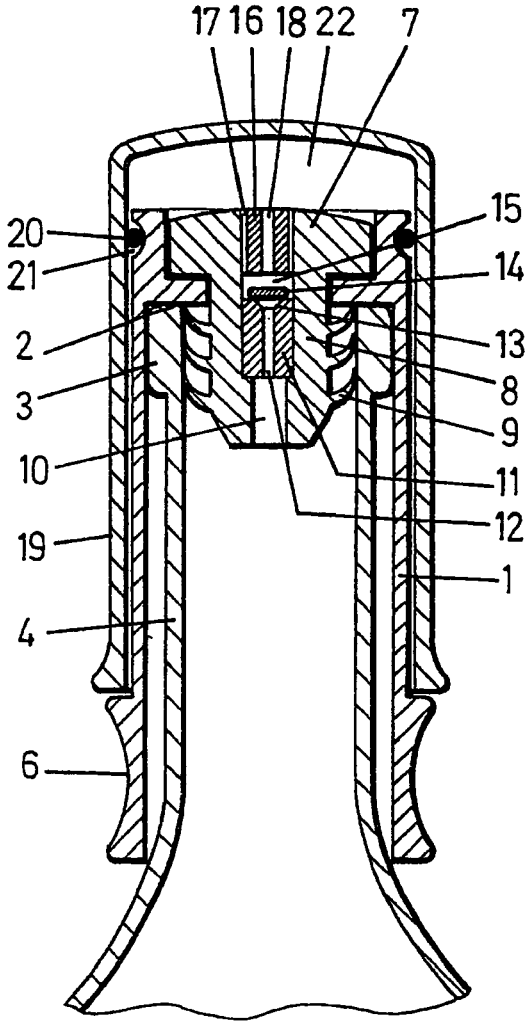
FIG. 2 shows a side elevational and diametrical section view of the vacuum pump of the previous figure, likewise coupled to the neck of a bottle, which is represented in a dotted line.
Figure 3:
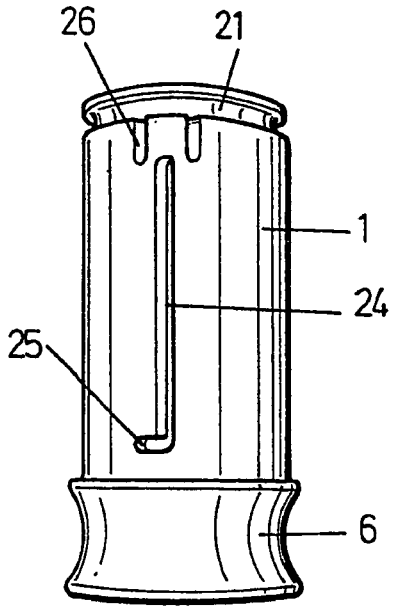
FIG. 3 shows a side elevational view of a detail of the intermediate support, in which both air outlet grooves corresponding to the one-way valve and the guide grooves for the movable cap are observed.
Figure 4:
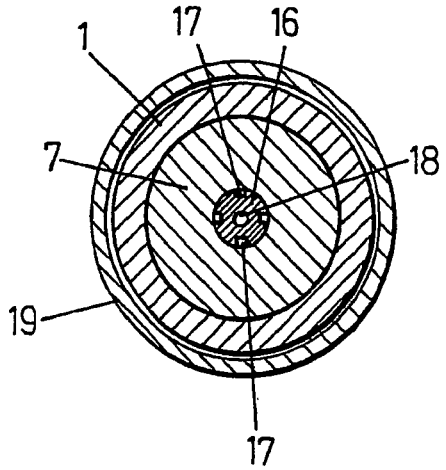
FIG. 4 shows a cross section view of a detail of the internal stopper at the level of its one-way valve.

In view of the described figures it can be observed how the vacuum pump proposed by the invention is constituted of a support (1) of a suitable rigid material, such as plastic for example, provided with a perimetral and internal restriction (2) close to its upper and free end, intended for acting as a stop on the throat (3) of the bottle, as is especially observed in FIG. 2, said support (1) being extended along the neck (4) of the bottle (5) and being finished off in a ring (6) of a recessed profile, which facilitates its manual gripping.

The perimetral restriction (2) furthermore constitutes the seating area for the expanded head (7) of a stopper (8), preferably of hard rubber, intended to penetrate inside the neck (4) of the bottle and to be integrally and tightly fixed thereto, with the collaboration of annular tabs (9), oversized with regard to the neck (4) of the bottle and which are deformed under pressure on the latter.

The stopper (8) incorporates an axial opening (10) with a stepping on which a small cylinder (11) rests, with an also small axial perforation (12) and with its external end (13) frusto-conically recessed, constituting the seating for a soft rubber disk (14), of slightly smaller diameter than that of the cylinder (11) in this area and which functions in a chamber (15) defined between the cylinder (11) and a second cylinder (16), the latter provided with, in addition to another axial opening (17), peripheral grooves (18) in correspondence with its generatrices and equiangularly distributed, the purpose of which will be described below.

The described structure is complemented with an also cylindrical cap (19), which can be moved on the support (1) in an axial and adjustable manner, as is also observed in FIG. 2, and which is connected to the latter close to its external end though an o-ring seal (20) housed in a channel (21) which will also be talked about below.

The cylinders (11) and (16) housed in the stopper (8) constitute a one-way valve insofar as when the cap (19) is axially moved outwards, the chamber (22) arranged between the bottom of said cap (19) and the head (7) of the stopper (8) progressively grows and is subjected to a negative pressure by being maintained externally closed though the seal (20) whereby said negative pressure is transmitted to the inside of the bottle (5) through the openings (12) and (17) and the grooves (18), the sealing disk (14) moving upwards, specifically resting on the internal end of the cylinder (16), covering its opening (17) but leaving its side grooves (18) open due to their smaller diameter, such that this negative pressure in the chamber (22) generates a suction inside the bottle (5).

Figure 1:
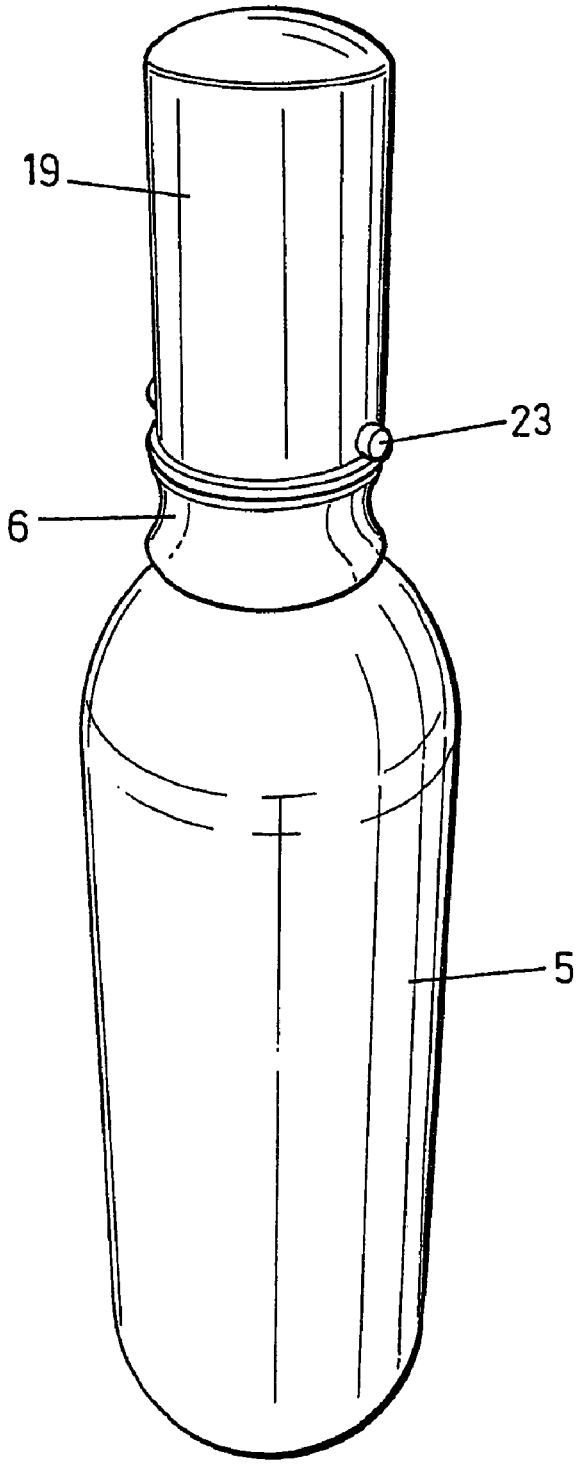
FIG. 1 shows a perspective view of a vacuum pump carried out according to the object of the present invention, duly coupled to the neck of a wine bottle.

The movement of the cap (19) is guided and limited by a pair of internal lugs (23), existing at the level of the mouth thereof, functioning in respective grooves (24) of the support (1), provided with an orthogonal bending (25) at its internal end which allows for locking said cap in the position shown in FIG. 1 by means of a slight rotation of the cap (19) with regard to the support (6).

When the cap begins the operation of axial movement in the opposite direction, the negative pressure existing in the chamber (20) is transformed into pressure, to the extent that the sealing disk (14) is moved upwards closing the opening (12) of the cylinder (11), and, accordingly, closing the internal valve to the stopper (8) while at the same time in this downwards movement of the cap (19), the o-ring seal (20) moves in the same direction on the channel (21), reaching an area of the support (1) in which the latter incorporates a series of grooves (26) establishing connection between the interior and exterior of the o-ring seal (20), and which, as a result, allow for the outward air discharge through the space defined between the cap (19) and the support (1).

With the structure described and as has been pointed out previously, an alternative movement of the cap (19) with regard to the support (1), maintaining the latter fixed though the handle (6), causes an absorbent and intermittent pumping effect of the air existing inside the bottle (5) towards the exterior, until achieving the suitable vacuum level inside said bottle.

The invention claimed is:

1. A vacuum pump for extracting air contained in a bottle of which a partial consumption has been carried out, the vacuum pump comprising a cylindrical support externally couplable to a neck of a bottle; an internal stopper coupled to said support through its head and also coupleable to an interior of the neck of the bottle in a fixed and tight manner, an external cap axially movable with regard to said intermediate support; an external one-way valve arranged between said cap and said support; and an internal one-way valve provided in said internal stopper, such that when said cap is moved axially outwardly said external valve is maintained close while said internal valve opens allowing for an absorption of air from an interior of the bottle to a chamber created between said stopper and said cap, whereas during an opposite movement of said cap said internal valve closes and said external valve opens, allowing for an outflow of air housed in said chamber toward an exterior.

2. A vacuum pump as defined in claim 1, wherein said support has an end configured as a ring and acting as a handle for manually stabilizing said support with regard to the bottle during a pumping operation, said support having an internal restriction through which it is restable on a throat of the bottle and through which it receives said internal stopper, said internal stopper having perimetral rings oversized with regard to the neck of the bottle and deformable under pressure on a surface of the neck so as to stabilize and heremetically close a coupling of said stopper to the neck.

3. A vacuum pump as defined in claim 1, wherein said internal stopper and said support are composed of plastic.

4. A vacuum pump as defined in claim 1, wherein said internal stopper has an axial opening provided with a perimetral stepping, a small cylinder located in said axial opening and having a further axial opening, another cylinder located in said axial opening of said stopper and spaced from said first cylinder, so that an inner chamber is defined between said cylinders, a soft-rubber sealing disk located in said inner chamber and having an undersized diameter with regard to said inner chamber, said second cylinder having peripheral grooves in a direction of its generatrices such that said sealing disk closes said axial opening of said first cylinder, but maintains said peripheral grooves of said second cylinder open when it is adapted to a base of said second cylinder.

5. A vacuum pump as defined in claim 1, wherein said support has a perimetral channel at its external face; and further comprising an O-ring seal housed in said perimetral channel, said channel having a radius of curvature which is substantially greater than a radius of said seal, such that said seal is axially movable when it is drugged by said cap in order to establish a closure of an upper area of said channel or to face grooves of said support, to establish a connection between either side of said seal when said seal is located at a lower end of said channel.

6. A vacuum pump as defined in claim 1, wherein said support has a pair of longitudinal and opposite grooves; and further comprising lugs located in said grooves and acting as guides for conducting and limiting a movement of said cap, said grooves being provided with a small orthogonal bending at their ends so as to allow a slight rotation of said cap for locking said cap in a position of maximum retraction.

* * * * *